US010051903B2

(12) United States Patent
Friedman

(10) Patent No.: US 10,051,903 B2
(45) Date of Patent: Aug. 21, 2018

(54) DETACHABLE PANTS PROTECTOR

(71) Applicant: Rachelle Friedman, Lakewood, NJ (US)

(72) Inventor: Rachelle Friedman, Lakewood, NJ (US)

( * ) Notice: Subject to any disclaimer, the term of this patent is extended or adjusted under 35 U.S.C. 154(b) by 5 days.

(21) Appl. No.: 15/205,086

(22) Filed: Jul. 8, 2016

(65) Prior Publication Data

US 2017/0006946 A1 Jan. 12, 2017

Related U.S. Application Data

(60) Provisional application No. 62/189,938, filed on Jul. 8, 2015.

(51) Int. Cl.

*A41D 27/14* (2006.01)
*A41D 13/05* (2006.01)
*A41D 17/00* (2006.01)

(52) U.S. Cl.

CPC ..... *A41D 27/145* (2013.01); *A41D 13/0543* (2013.01); *A41D 17/00* (2013.01); *A41D 17/005* (2013.01); *A41D 2300/32* (2013.01); *A41D 2300/322* (2013.01); *A41D 2300/328* (2013.01); *A41D 2300/33* (2013.01); *A41D 2400/422* (2013.01); *A41D 2400/52* (2013.01); *A41D 2500/50* (2013.01)

(58) Field of Classification Search

CPC .... A41D 27/145; A41D 13/053; A41D 17/00; A41D 17/005
USPC ..... 2/232, 231, 242, 23, 24
See application file for complete search history.

(56) References Cited

U.S. PATENT DOCUMENTS 2,429,507 A * 10/1947 Ballenger ..... A41D 3/06 2/46
2,495,863 A * 1/1950 Paige ..... A41B 9/02 2/231
2,637,916 A * 5/1953 Pagano ..... A41D 3/06 16/353
4,964,176 A * 10/1990 Previdi ..... A41D 17/00 2/22
5,031,247 A * 7/1991 Carter ..... A41D 13/0543 2/22
5,173,967 A * 12/1992 Carter ..... A41D 13/0543 2/16
5,381,557 A * 1/1995 Luria ..... A01M 1/14 2/16
5,613,250 A * 3/1997 Bell ..... A41D 17/00 2/22

(Continued)

*Primary Examiner* — Gloria Hale
(74) *Attorney, Agent, or Firm* — Ostrolenk Faber LLP

(57) ABSTRACT

A protector for pants bottoms that serves to protect the pants bottoms from being wetted by rain, is formed of a generally tubular body having a smaller cross-section at a side adjacent a bottom opening and a wider cross-section side adjacent at its top opening. An attachment mechanism allows attaching the pants protector to one side of the pants, adjacent the knee of the wearer, and the protector is constructed to have the appearance and look of a pants bottom portion, mimicking the pants itself, from an area at the bottom of the pants to at least approximately the knee location. Thereby, during rain, upon donning a pair of the pants protectors, the bottom of the pants is protected from driving rains and one who appears at a formal event is able to remove the protectors and be left with spotless pants.

13 Claims, 3 Drawing Sheets

(56) References Cited

U.S. PATENT DOCUMENTS 5,815,948 A * 10/1998 Dzielak ..... A41D 17/00
2/22

* cited by examiner

DETACHABLE PANTS PROTECTOR

CROSS REFERENCE OF THE RELATED APPLICATION(S)

This present application claims benefit of and priority to U.S. Provisional Application No. 62/189,938 filed on Jul. 8, 2015, entitled "DETACHABLE PANTS PROTECTOR," the entire contents of which are hereby incorporated by reference.

BACKGROUND OF THE INVENTION

The present invention is generally directed to the field of garments and, more particularly, to slip-on pants protectors that are designed to protect the pants from the knees to the shoes during inclement weather.

Garment protectors are described in the prior art, including in U.S. Pat. Nos. 7,404,215; 3,722,001; 4,896,379; and 2,677,829. The entire contents of the aforementioned patents are incorporated by reference herein.

The U.S. Pat. No. 7,404,215 is directed to a detachable protective cuff guard for pants, which is primarily concerned with protecting the bottoms of the pants, the protector hanging close to the ground and over the heel of the shoe. It is a detachable protector made of durable synthetic materials such as neoprene, nylon, weather-treated canvas, and other such durable, water and/or stain resistant materials.

Nonetheless, many have realized that when they go out in the rain, their raincoats will protect all of their clothing, but typically only down to their knees. They wear rubbers or boots that are supposed to provide protection for their shoes. But the part that is exposed to the rain is the part of the pants from the knees down to the hem of the pants, i.e., to the shoes. Therefore, on occasions when people are dressed up for a formal dinner or an event, when they arrive at their destination, their suit jacket and top half of their pants will be fully dry, but the bottom part of the pants is drenched and unseemly.

SUMMARY OF THE INVENTION

It is an object of the present invention to provide detachable protective guards over the bottom portions of pants.

It is another object of the invention to provide pants protectors that avoid the aforementioned drawbacks of the prior art.

It is yet another object of the invention to provide pants protectors that are easy to don and which would keep the pants dry without the pants being wrinkled.

A still further object of the invention is to provide pants protectors that, upon arriving at one's destination, can be nicely and easily stored away in a pocket of a coat without wetting or dirtying the coat pocket.

The foregoing and other objects of the invention are realized in accordance with the invention with pants protectors that have the features described below. More specifically, in one embodiment thereof, the invention comprises a protector for pants bottoms, to protect the pants bottoms from being wetted by rain, the protector comprising: a generally tubular body having a smaller cross-sectional side adjacent a bottom opening thereof and a wider cross-sectional side adjacent a top opening thereof; an attachment mechanism for attaching the pants protector to pants adjacent the knee of a wearer; and wherein the protector is constructed to have the appearance of a pair of pants over which the protector is donned, from an area at the bottom of a pair of pants to at least approximately adjacent to the knee location of the pair of pants.

Preferably, the pants protector has a press line on a front portion thereof, which matches a press edge line of a pair of pants, and preferably, the pants protector has a cuff at the bottom opening thereof, and preferably the cross-sectional size of the protector gradually increases from the bottom opening to the top opening.

Preferably, a zipper is included that extends vertically and which is opened during donning of the pants protector, and then closed.

Preferably, the attachment mechanism comprises a pair of safety pins, and, preferably, the attachment mechanism alternatively comprises a string located adjacent the top opening of the protector and that can be tied to assure that the pants protector will not slide relative to the pair of pants. Alternatively, an adhesive strip is included that has on at least one side thereof an adhesive layer that will temporarily hold to the pants.

Preferably, the pants protector comprises a folded over edge at the top thereof, and a pocket in which the pants protector can be stored, as when wet. The pocket comprises a pocket attacher mechanism that enables the pocket to be attached to the pair of pants. The pocket attaching mechanism comprises half of a hook-and-loop strip, and a complementary half of a hook-and-loop structure being provided on the protector. Preferably, the pocket comprises a facility that enables it to be tied around the protector. Preferably, the pants protector is made of a use-once, throw away material and the material of the pants protector is synthetic.

Other features and advantages of the present invention will become apparent from the following description of the invention which refers to the accompanying drawings.

DETAILED DESCRIPTION OF EMBODIMENTS OF THE INVENTION

Figure 1:
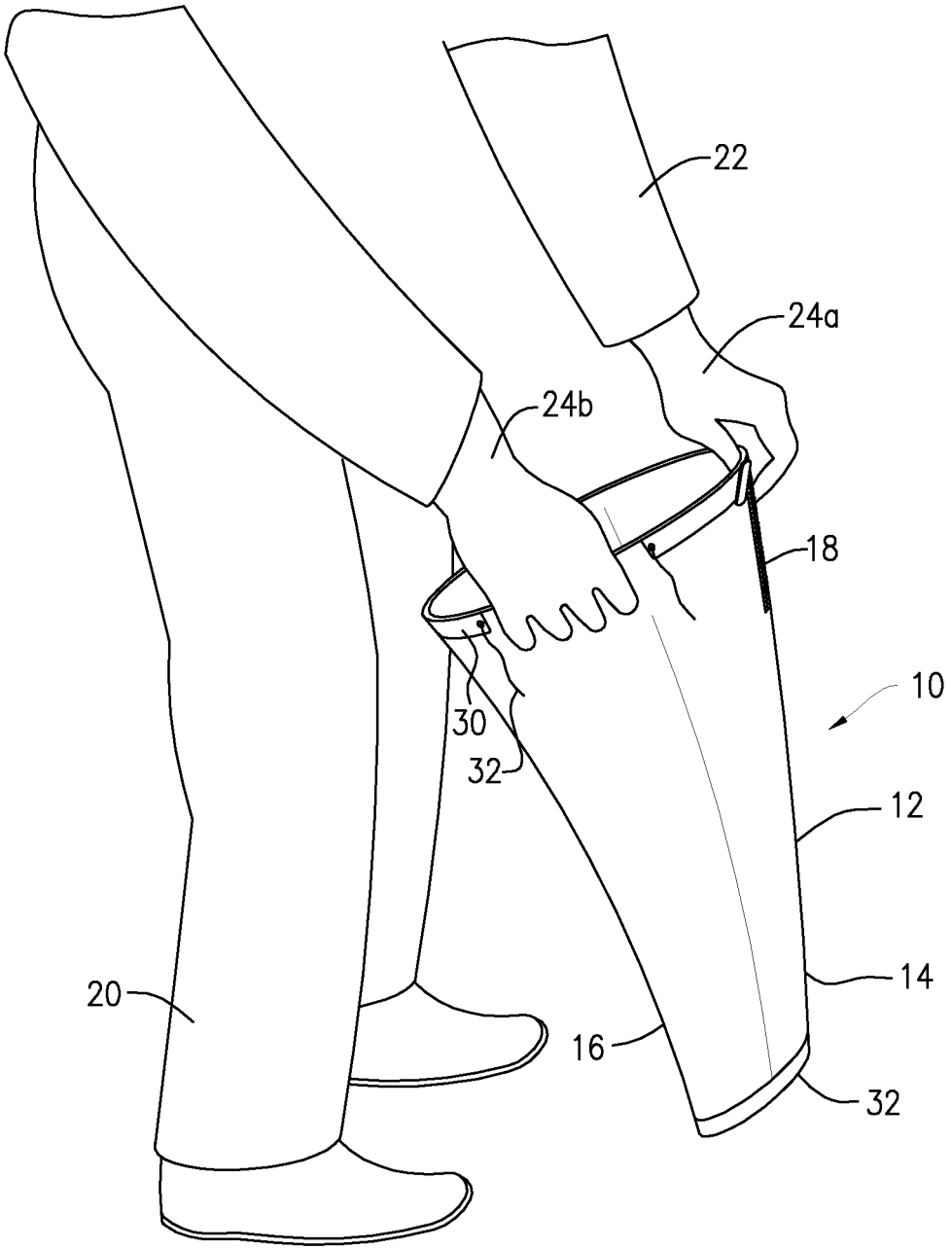
FIGS. 1 and 2 illustrate aspects of the pants protectors of the present invention.

With reference to FIG. 1, the over-the-pants protector 10 described herein can be made of an outer material that has a seamline 12 and is pressed to have a front edge 14 and a rear edge 16, matching the press lines on a pair of dress pants, with, optionally, a zipper 18 at the top section or possibly a doubled over upper edge 30 with a tightening strings 32. The reference numeral 30 may alternatively designate a separate band with tightening strings 32 that are simply wrapped around the protector to hold the protector up without slipping. It also represents yet another alternative, namely a pair of straps, one attached to the front and the other to the rear of the protector 10, with the other ends of the straps attachable to the belt of the wearer, by being slipped under and around the belt or by being fastened to the belt by Velcro, or the like.

Figure 2:
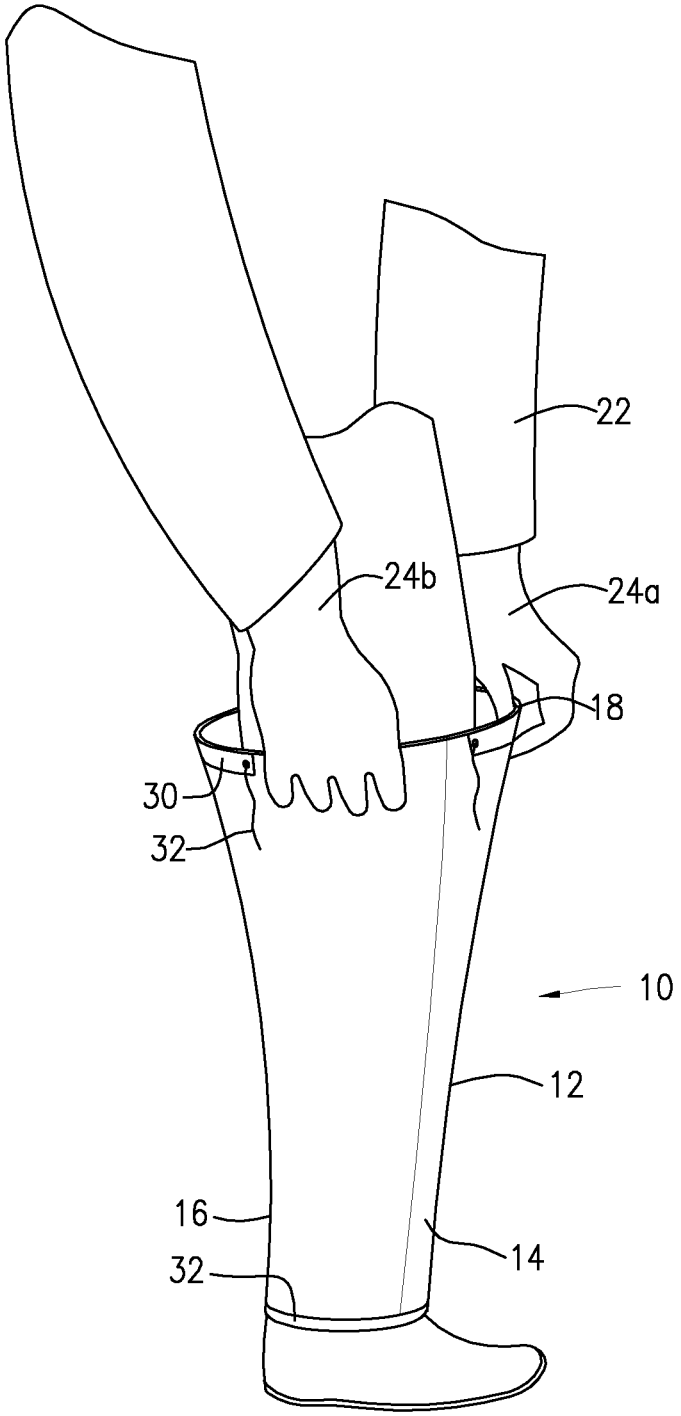

Thereby, the person 20 can easily don the pants protectors 10 over an existing pair of pants by holding each protector 10 at two locations with his arms 22, more specifically his hands 24*a*, 24*b*, and donning the protector, for example, as shown in FIG. 2, until both protectors 10 are fully donned, as shown in FIG. 2. Thereby, when fully donned, the protectors 10 which, as depicted, may have bottom cuffs 31, match the appearance of the pants and, when the coat is on, would not be unseemly or objectionable, even to people who are very caring about their clothing.

Figure 3B:
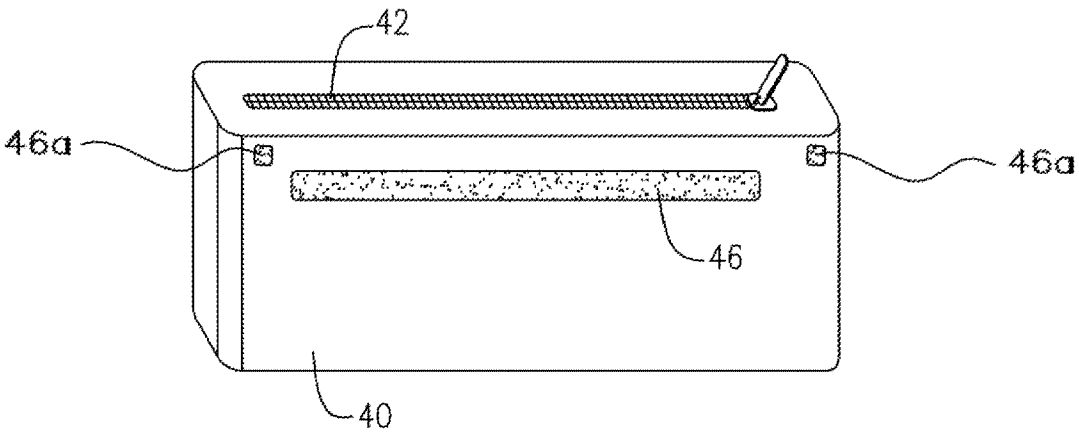
FIGS. 3*a* and 3*b* show additional aspects of the pants protector of the present invention.
Figure 3A:
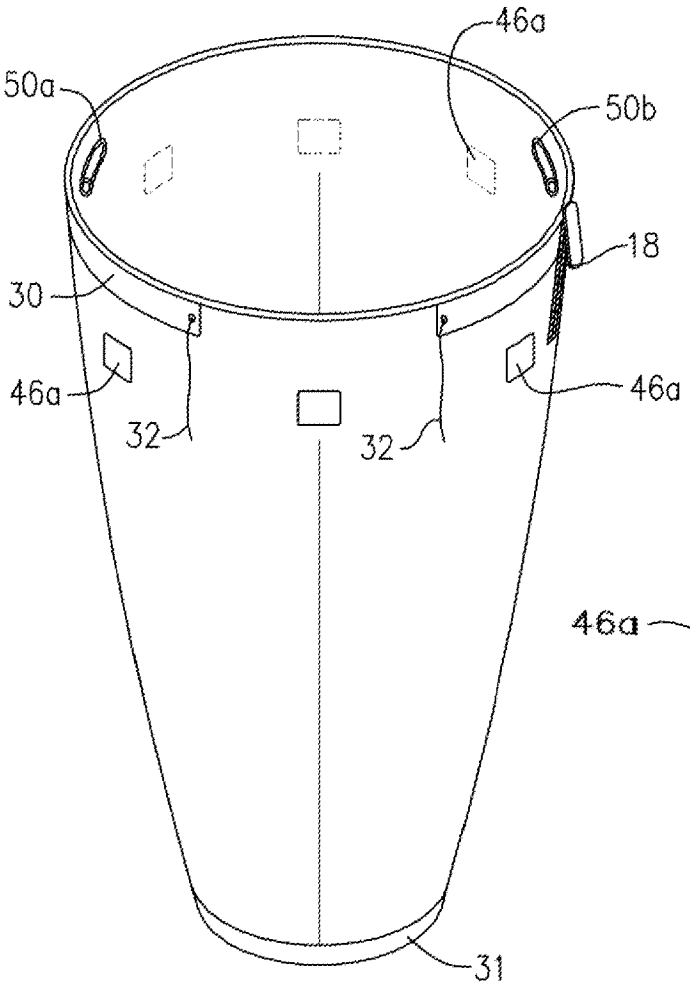

FIG. 3*a* also illustrates that the cross-sectional size, e.g. the internal diameter or size of the protector of the pants protector 10, is larger at the top than at the bottom, to accommodate the corresponding increasing cross-sectional size of a pair of pants at each leg. Also note the safety pins 50*a*, 50*b* at each side, that permit the pants protectors 10 to be pinned to the pants slightly below or even above the knee of the wearer. With safety pins 50*a*, 50*b*, the tightening of the pants protector with the string 32 is not necessary, and this also avoids the wrinkling of the pants at the point of support of the pants protectors on one's pants. Alternatively, adhesive strips 50*a* and 50*b* permit the protector 10 to lightly and removeably adhere to the wearer's pants.

Preferably, the pants protector 10 of the present invention comprises an inner waterproof lining that is sewn inside the pants protector, while the outer material has an authentic look of a suit pants.

The protectors can be held up by various means, including by an elastic band that is built into the top edge of the pants protector or by any other means.

The pants protector of the present invention can be provided in many different sizes, colors, and lengths, with or without cuffs on the bottom, to suit individual preferences.

In the further embodiment shown in FIGS. 3*a* and 3*b*, a small pocket 40 is provided in which a bag made of a very thin plastic wall is stored, possibly by being attached with a string and when pulled out and having its zipper opening opened, the entire wet protector can be stuffed therein, reduced to a very small package size, and then stored in one's coat pocket while one is at the formal party, event, business meeting or the like.

More specifically, the pocket 40 in FIG. 3*b* has an upper zipper 42 and a Velcro®, e.g. hook-and-loop, strip 46 that can be attached around the pants protector 10 at corresponding Velcro®, or hook-and-loop components 46*a* and then the pocket 40 can be used to store therein a wet pants protector, as previously described.

As another option, the top part of the protectors can be made to roll down, so that a person can determine for themselves at which height to attach this protectors 10 to their pants, i.e., whether below the knee, or just over the knee or higher up at the calf of the pants. For example, to this end, the upper portion of the protector may be made of a much thinner or even plastic material because the protector would not be visible in its portion, which is above the knee, under a person's raincoat.

The pants protector of the present invention can have a length that is preferably in the range of 18-26 inches and it can come in a variety of sizes to suit pants styles, as well as in many different colors and styles, whereby a user can purchase for themselves the type of protector that matches their clothing.

In further embodiments of the invention, the pants protectors can be constructed as "use-once" items that are used once and then discarded and normally dispensed from a box containing multiple protectors, similar to a tissue box and the material of the pants protectors can be made of a synthetic material that mimics fabric and has a very thin lining or is impregnated with a material that makes them waterproof.

Preferably, the material of the protector is such that it will retain its pressed look even after it has become thoroughly wetted, once it is folded along the right seam and stored away appropriately.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A protector for pants bottoms, to protect the pants bottoms from being wetted by rain, the protector comprising:

a generally tubular body having a smaller cross-sectional size adjacent a bottom end thereof and a wider cross-sectional size adjacent a top end thereof;

an attachment mechanism for attaching the pants protector to pants at the top end of the pants protector;

wherein the protector is constructed to have an appearance of a pair of pants over which the protector is donned, from an area at the bottom of a pair of pants to at least approximately adjacent a knee location of the pair of pants;

wherein the pants protector has a press line on a front portion thereof, which matches a press edge line of a pair of pants; and wherein the pants protector has a cuff at the bottom opening thereof.

2. The protector of claim 1, wherein the cross-sectional size of the protector gradually increases from the bottom end to the top end.

3. The protector of claim 1, including a zipper that extends vertically and which is opened during donning of the pants protector, and then closed.

4. The protector of claim 1, wherein the attachment mechanism comprises a pair of safety pins.

5. The protector of claim 1, wherein the attachment mechanism comprises a string located adjacent the top opening of the protector and that can be tied to assure that the pants protector will not slide relative to the pair of pants.

6. The pants protector of claim 1, further including an adhesive strip that has on at least one side thereof an adhesive layer that will temporarily hold to the pants.

7. The pants protector of claim 1, wherein the pants protector comprises a folded over edge at the top thereof.

8. The pants protector of claim 1, in combination with a pocket in which the pants protector can be stored, as when wet.

9. The pants protector of claim 8, wherein the pocket comprises a pocket attacher mechanism that enables the pocket to be attached to the pair of pants.

10. The pants protector of claim 9, wherein the pocket attaching mechanism comprises half of a hook-and-loop strip, and a complementary half of a hook-and-loop structure being provided on the protector.

11. The pants protector of claim 8, wherein the pocket comprises a facility that enables it to be tied around the protector.

12. The pants protector of claim 1, wherein the pants protector is made of a use-once, throw away material.

13. The pants protector of claim 12, wherein the material of the pants protector is synthetic.

* * * * *